US006355208B1

(12) United States Patent
Unami et al.

(10) Patent No.: US 6,355,208 B1
(45) Date of Patent: Mar. 12, 2002

(54) DIE LUBRICANT AND IRON-BASED POWDER MIXTURE FOR WARM COMPACTION WITH DIE LUBRICATION, AND PROCESSES FOR PRODUCING HIGH-DENSITY IRON-BASED GREEN AND SINTERED COMPACTS

(75) Inventors: Shigeru Unami; Yukiko Ozaki; Satoshi Uenosono, all of Chiba (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/631,033

(22) Filed: Aug. 2, 2000

(30) Foreign Application Priority Data

Oct. 29, 1999 (JP) ..... 11-308590
Apr. 6, 2000 (JP) ..... 12-105050

(51) Int. Cl.[7] ..... B22F 3/12

(52) U.S. Cl. ..... 419/11; 419/17; 419/38; 419/65; 419/66; 75/231; 75/243; 75/246; 75/252; 524/227; 524/394; 524/398; 525/240

(58) Field of Search ..... 524/227, 394, 524/398; 525/240; 75/252, 231, 243, 246; 419/65, 66, 11, 17, 38

(56) References Cited

U.S. PATENT DOCUMENTS 3,556,255 A * 1/1971 Lomax, Jr.
5,093,076 A * 3/1992 Young et al.
5,256,185 A 10/1993 Semel et al. ..... 75/252
5,368,630 A 11/1994 Luk ..... 75/255
5,682,591 A * 10/1997 Inculet et al. ..... 419/38
5,767,426 A * 6/1998 Oliver et al. ..... 75/246
5,976,215 A * 11/1999 Uenosono et al. ..... 75/252
6,139,600 A * 10/2000 Ozaki et al. ..... 75/255

FOREIGN PATENT DOCUMENTS

JP A-2-156002 6/1990
JP A-7-103404 4/1995

* cited by examiner

*Primary Examiner*—Ngoclan Mai
(74) *Attorney, Agent, or Firm*—Oliff & Berridge, PLC

(57) ABSTRACT

A process for producing a high-density iron-based green compact is provided that can form a green compact with a high density. Also provided is a process for producing a sintered compact from the green compact. A specified combination lubricant is applied to the surface of a die for compacting by electrical charging, wherein the combination lubricant includes a first lubricant having a melting point that is higher than a preset compacting temperature, and a second lubricant having a melting point that is lower than a compacting temperature. A heated iron-based powder mixture is filled into the die, followed by compacting, whereby a green compact is formed. The green compact can be sintered to provide a sintered compact. The powder mixture comprises an iron-based powder, a lubricant and a graphite powder, wherein the lubricant includes a first lubricant having a melting point that is lower than the compacting temperature and in an amount from 10 to 75% by mass, and a second lubricant having a melting point that is higher than the compacting temperature, and the content of the graphite powder is less than 0.5% by mass based on the total amount of the iron-based powder mixture.

23 Claims, No Drawings

DIE LUBRICANT AND IRON-BASED POWDER MIXTURE FOR WARM COMPACTION WITH DIE LUBRICATION, AND PROCESSES FOR PRODUCING HIGH-DENSITY IRON-BASED GREEN AND SINTERED COMPACTS

BACKGROUND OF THE INVENTION

1. Field of the Invention

This invention relates to processes for the production of green and sintered compacts made from iron-based powder. More particularly, the invention relates to lubricants for use in producing a high-density, green compact made from iron-based powder by warm compaction.

2. Description of the Related Art

In general, a powdered iron-based green compact for powder metallurgy is produced by filling an iron-based powder mixture into a die. The powder mixture is generally derived by mixing an iron-based powder with alloying powders such as copper powder, graphite powder and the like and further with lubricants such as zinc stearate, lead stearate and the like, and then compacting the iron-based powder mixture. The resultant green compact usually has a density in the range from 6.6 to 7.1 $Mg/m^3$.

Such a green compact is further sintered to obtain a sintered compact which, where desired, is sized or cut into a powder metallurgical product. Where great strength is required, a carburizing heat treatment or brightening heat treatment is, in some instances, performed after sintering.

The above described powder metallurgy process permits components having complicated shapes to be formed with high dimensional accuracy and in near net shape, significantly saving the cost of cutting work as contrasted to conventional production methods.

Recently, the demand for powder metallurgical iron products having higher dimensional accuracy and higher strength has increased. The increased demand for such products is due, in part, to the desire to omit excess cutting work and minimize production costs, and to obtain smaller and lighter products.

In order to increase the strength of a powder metallurgical product, it is beneficial to form high-density sintered compacts from an iron-based green compact that has been produced to have a high density. As the density of a sintered compact increases, the number of voids in the compact decreases so that the compact exhibits improved mechanical properties such as tensile strength, impact value, fatigue strength and the like.

As compacting techniques evolved to form high-density iron-based green compacts, a double pressing-double sintering method has been proposed, in which an iron-based powder mixture is pressed and sintered in the usual manner, followed by repeated pressing and sintering, and a sinter forging method has been proposed, in which single pressing and single sintering are performed, followed by hot forging.

Moreover, warm compaction techniques are known in which metal powder is compacted with heat as disclosed for instance in Japanese Unexamined Patent Application Publication No. 2-156002, Japanese Examined Patent Application Publication No. 7-103404, U.S. Pat. Nos. 5,256,185 and 5,368,630. Such warm compaction techniques are designed to melt and disperse a lubricant partly or wholly between powder particles to reduce frictional resistance between the powder particles and frictional resistance between a green compact and an associated die, so that improved compressibility is attained. The compaction technique noted here is thought to be most advantageous in view of possible cost savings over the methods previously mentioned for the production of high-density green compacts. A green compact of about 7.30 $Mg/m^3$ in density can be obtained by the above warm compaction technique when an iron-based powder mixture is compacted at a pressure of 686 MPa and at a temperature of 150° C.; and wherein the powder mixture is derived by mixing a partially alloyed iron powder of a Fe-4Ni-0.5Mo-1.5Cu with 0.5% by mass of graphite and 0.6% by mass of lubricant.

However, the problem with the warm compaction techniques of the above-cited publications, i.e., Japanese Unexamined Patent Application Publication No. 2-156002, Japanese Examined Patent Application Publication No. 7-103404, U.S. Pat. Nos. 5,256,185 and 5,368,630, is that because the iron-based powder mixture is less fluid and thus less productive, the resultant green compact exhibits an irregular density, and the resultant sintered compact exhibits physical properties having undesirable variations. Another drawback is that because a high force must be applied to eject the green compact from the corresponding die, the surface of the compact is often marred and the lifetime of the die is often shortened.

In these warm compaction techniques, a lubricant is also contained in an iron-based powder mixture so as to reduce resistance between powder particles and resistance between a green compact and an associated die, thereby providing improved compressibility. During warm compaction, the lubricant is partly or wholly melted and then introduced so that the lubricant is adjacent to the surface of the green compact. Upon subsequent sintering, the lubricant thermally decomposes or volatilizes and hence escapes from the green compact, leaving coarse voids near the surface of the sintered compact. The resulting voids decrease the overall mechanical strength of the sintered compact.

To cope with this problem, Japanese Unexamined Patent Application Publication No. 8-100203 discloses that when room temperature compaction or warm compaction is performed, the amount of lubricant incorporated into an iron-based powder mixture should be decreased by coating the surface of a die with an electrical charged lubricant powder such that a high-density green compact can be produced. In this technique, however, the coating lubricant is susceptible to morphological changes at temperatures near its melting point that cause the lubricity of the lubricant to vary greatly. As result, the compacting temperature range is largely dependent on the melting point of the coating lubricant. Moreover, even if the amount of the lubricant in the powder mixture can be decreased by applying a coating lubricant to the die surface, the amount of the former lubricant may be too low to exhibit adequate lubricity and to enhance the density of a green compact depending on the lubricant components to be incorporated in the powder mixture.

Because of the growing demand for high strength, low cost automotive parts, there is an increasing need for a single compacting process capable of producing a high density iron-based green compact.

SUMMARY OF THE INVENTION

In order to eliminate at least some of the foregoing problems of the conventional art, a first object of the present invention is to provide a process for producing high-density iron-based green compacts that can form a high-density green compact with a density of at least 7.4 $Mg/m^3$ by single pressing when warm compaction is effected as to an iron-based powder mixture formed by mixing a partially alloyed iron powder having, for example, a Fe-4Ni-0.5Mo-1.5Cu composition, with 0.5% by mass of a graphite powder.

A second object of the invention is to provide a process for producing high-density iron-based sintered compacts that permits a high-density sintered compact to be formed by sintering such an iron-based green compact.

To achieve the above and other objects by utilizing a warm compaction technique and a die lubrication technique, the present inventors have conducted extensive research on various lubricants for die lubrication and various formulations of iron-based powder mixtures containing lubricants. The present inventors have found that the ejection force for an iron-based green compact from the corresponding die can be effectively reduced by using a specific combination lubricant to lubricate the die. This combination lubricant comprises a suitable ratio of a first lubricant having a melting point that is lower than a preset compacting temperature and a second lubricant having a melting point that is higher than the compacting temperature, and can be applied to the surface of a preheated die by electrical charging.

The present invention has been made on the basis of the above findings and further supporting studies.

More specifically, according to a first embodiment of the invention, there is provided a die lubricant for warm compaction with die lubrication, comprising a mixture of a first lubricant having a melting point that is higher than a preset compacting temperature, and a second lubricant having a melting point that is lower than the compacting temperature, and that can be applied to the surface of a preheated die by means of electrical charging when a powder is compacted in the die.

According to this invention, there is provided a combination of die lubricant for warm compaction with die lubrication, comprising a first lubricant having a melting point that is higher than a preset compacting temperature and in an amount from 0.5 to 80% by mass, and a second lubricant having a melting point that is lower than the compacting temperature as a balance, wherein the lubricant can be applied to a surface of a preheated die by means of electrical charging when a powder is compacted in the die.

In this invention, the higher-melting lubricant is at least one member selected from the group consisting of metallic soap, thermoplastic resin, thermoplastic elastomer, and an organic or inorganic lubricant having a layer crystal structure.

In this invention, the lower-melting lubricant is at least one member selected from the group consisting of metallic soap, amide wax, polyethylene, and a eutectic mixture of at least two members thereof.

According to a second embodiment of the invention, there is provided an iron-based powder mixture for warm compaction with die lubrication, comprising an iron-based powder and a lubricant. The lubricant comprises a first lubricant having a melting point that is lower than a preset compacting temperature and an amount from 10 to 75% by mass based on the total amount of the lubricant, and a second lubricant having a melting point that is higher than the compacting temperature as the balance.

According to this second embodiment of the invention, there is provided an iron-based powder mixture for warm compaction with die lubrication, comprising an iron-based powder, a lubricant and a graphite powder. The lubricant comprises a first lubricant having a melting point that is lower than a preset compacting temperature and in an amount from 10 to 75% by mass based on the total amount of the lubricant, and a second lubricant having a melting point that is higher than the compacting temperature as the balance, and the content of the graphite powder being less than 0.5% by mass based on the total amount of the iron-based powder mixture.

In the this second embodiment of the invention, the content of the lubricant in the power mixture is preferably in the range from 0.05 to 0.40% by mass.

According to a third embodiment of the invention, there is provided a process for the production of a high-density iron-based green compact, comprising: preheating a die to a selected temperature; applying a die lubricant for warm compaction with die lubrication to the surface of the die at the selected temperature by electrical charging; filling a heated iron-based powder mixture into the die; and then compacting the mixture at a preset compacting temperature. The die lubricant for warm compaction with die lubrication comprises a first lubricant having a melting point that is higher than the compacting temperature and in an amount from 0.5 to 80% by mass, and a second lubricant having a melting point that is lower than the compacting temperature as the balance. The iron-based powder mixture comprises an iron-based powder and a lubricant. The lubricant comprises a first lubricant having a melting point that is lower than the compacting temperature and in an amount from 10 to 75% by mass based on the total amount of the lubricant, and a second lubricant having a melting point that is higher than the compacting temperature as a balance.

In this third embodiment of the invention, the graphite powder can be also added in an amount less than 0.5% by mass based on the total amount of the iron-based powder mixture.

In this third embodiment of the invention, the higher-melting lubricant is a member selected from the group consisting of metallic soap, thermoplastic resin, thermoplastic elastomer, and an organic or inorganic lubricant having a layer crystal structure.

The lower-melting lubricant is a member selected from the group consisting of metallic soap, amide wax, polyethylene, and a eutectic mixture of at least two members thereof.

The lubricant for in the powder mixture is preferably added in an amount from 0.05 to 0.40% by mass.

The present invention can also provide a high-density sintered compact produced by single pressing.

In a fourth embodiment of the invention, there is provided a process for the production of a high-density iron-based sintered compact, comprising the step of further sintering the high-density iron-based green compact produced by the process according to any one of the above-mentioned processes, thereby forming the sintered compact.

The above and other objects, features and advantages of the present invention will become manifest upon reading of the following detailed description.

DESCRIPTION OF THE PREFERRED EMBODIMENTS

In the practice of the present invention, a heated iron-based powder mixture is filled into a die and then compacted to form an iron-based green compact is obtained. The compacting is typically performed at a selected preset compacting temperature.

In the invention, a die to be used for compacting is preheated at a suitable temperature. The preheating temperature is not particularly restricted so long as an iron-based powder mixture can be maintained at a preset compacting temperature. The preheating temperature is set to be preferably higher than the compacting temperature by 20 to 60° C.

An electrically charged die lubricant is introduced into the preheated die and applied to the surface of the die by electrical charging. Preferably, the lubricant (solid powder) is placed in a die lubricating system (for example, Die Wall Lubricant System manufactured by Gasbarre Co.) where electrical charging is performed by means of contact charging between the solid lubricant particles and the inner wall of the system. The electrically charged lubricant is then jetted into the die and applied to the die surface by electrical charging. The amount of the lubricant to be applied to the die surface by electrical charging is set preferably in the range from 5 to 100 $g/m^2$. Amounts less than 5 $g/m^2$ result in insufficient lubricating action, needing a high ejection force. Amounts greater than 100 $g/m^2$ cause the lubricant to remain on the surface of the green compact, making the compact unsightly in appearance.

The die lubricant for warm compaction with die lubrication is used in electrically charged relation to the surface of the preheated die before compacting. This lubricant is a mixture of a first lubricant having a melting point that is higher than a preset compacting temperature and in an amount from 0.5 to 80% by mass, and a second lubricant having a melting point that is lower than the compacting temperature as the balance. The preset compacting temperature used herein refers to a temperature as measured on the die surface at the time compacting is performed.

The higher-melting lubricant is present in a solid state in the die lubricant for warm compaction with die at the time compacting is performed, and it behaves like a solid lubricant that acts as "a roller" within a die, consequently reducing the amount of ejection force needed to eject a green compact from the die. Moreover, the higher-melting lubricant prevents a completely or partially molten lubricant (i.e., the lower-melting lubricant to be described later) from migrating within the die, decreasing the frictional resistance between the compact and the die surface so that the ejection force is maintained at a desired low level.

If the content of the higher-melting lubricant is less than 0.5% by mass, the lower-melting lubricant becomes relatively abundant. This causes a large amount of molten lubricant to migrate within the die and to become unevenly distributed on the surface of the die, thereby increasing frictional resistance between the green compact and the die surface and hence failing to reduce the amount of force needed to eject the compact from the die. Conversely, if the content of the higher-melting lubricant is greater than 80% by mass, an amount of non-melting lubricant becomes too great to be uniformly distributed on the surface of the die. This results in diminished die lubrication and makes it necessary to apply a greater force to eject the green compact from the die. Hence, the content of the higher-melting lubricant present in the lubricant for warm compaction with die lubrication is preferably within the range from 0.5 to 80% by mass.

The die lubricant for warm compaction with die lubrication contains, in addition to the above-specified higher-melting lubricant, a second lubricant having a melting point that is lower than the preset compacting temperature. This lower-melting lubricant melts completely or partially at the compacting temperature and creates a grease-like coating on the surface of the die, that allows the green compact to be ejected from the die using less force.

The higher-melting lubricant is preferably a member selected from the group consisting of metallic soap, thermoplastic resin, thermoplastic elastomer, and an organic or inorganic lubricant having a layer crystal structure. Suitable examples are chosen from the following lubricants depending upon the compacting temperature used.

As the metallic soap, zinc stearate, lithium stearate, lithium hydroxystearate or the like is preferred. As the thermoplastic resin, polystyrene, polyamide, fluorine resin or the like is preferred. As the thermoplastic elastomer, polystyrene elastomer, polyamide elastomer or the like is preferred. The inorganic lubricant of a layer crystal structure is graphite, $MoS_2$ or carbon fluoride, and finer particle sizes are more effective in reducing the amount of the ejection force. The organic lubricant of a layer crystal structure is melamine-cyanuric acid adduct (MCA) or N-alkyl aspartate-β-alkyl ester.

The lower-melting lubricant is preferably a lubricant that melts completely, or at least partially, at the compacting temperature and that can be applied to the surface of a die at a low melting point by electrical charging. This lower-melting lubricant is preferably a member selected from the group consisting of metallic soap, armide wax, polyethylene, and an eutectic mixture of at least two members thereof. Suitable examples are chosen from the following lubricants depending upon the compacting temperature used.

As the metallic soap, zinc stearate or calcium stearate is preferred. As the amide wax, ethylene bis-stearoamide, monoamide stearate or the like is preferred. As the eutectic mixture, ethylene bis-stearoamide-polyethylene eutectic, ethylene bis-stearoamide-zinc stearate eutectic, ethylene bis-stearoamide-calcium stearate eutectic is preferred.

Subsequently, a heated iron-based powder mixture is filled into a die electrically charged with a die lubricant, followed by compacting, whereby a green compact is obtained.

The iron-based powder mixture is preferably heated at a temperature from 70 to 200° C. Temperatures lower than 70° C. result in an iron powder having increased yield stress that causes a green compact to have a decreased density. Conversely, temperatures higher than 200° C. show no appreciable rise in density, creating a risk that the iron powder will oxidize. Thus, the temperature at which the iron-based powder mixture is heated is preferably within the range from 70 to 200° C.

The iron-based powder mixture is formed by mixing an iron-based powder with an internal lubricant or an alloying powder. No specific method of mixing or specific alloying powder is preferred. In the case where the iron-based powder is mixed with the alloying powder, it is preferred that after completing primary mixing of the iron-based powder and alloying powder with a part of the lubricant, secondary mixing be performed by stirring the resultant mixture at a temperature that is higher than the melting point of at least one of the aforesaid lubricants so that at least one of the lubricants melts, and then stirring the mixture so that the mixture cools and so that the melted lubricant can be applied to the surface of the iron-based powder mixture so that the alloying powder is bonded, followed by mixing of the balance of the lubricant.

The iron-based powder according to the present invention is selected from among pure iron powders such as an atomized iron powder, a reduced iron powder or the like, a partially alloyed steel powder, a prealloyed steel powder, and a mixed powder thereof.

The amount of the lubricant in the iron-based powder mixture is set preferably in the range from 0.05 to 0.40% by mass based on the total amount of the iron-based powder mixture. Amounts less than 0.05% by mass make the resultant iron-based powder mixture less fluid and cause the lubricant to be unevenly applied to the surface of a die, producing a green compact having decreased density. Conversely, amounts greater than 0.40% by mass produce high voiding after sintering and result in a sintered compact having decreased density.

The lubricant contained in the iron-based powder mixture is a mixed lubricant obtained by mixing a first lubricant having a melting point that is lower than the preset compacting temperature and a second lubricant having a melting point that is higher than the compacting temperature. The amount of the lower-melting lubricant is preferably in the range from 10 to 75% by mass, whereas the amount of the higher-melting lubricant is preferably in the range from 25 to 90% by mass as the balance. The lower-melting lubricant is effective in that it melts during compacting, penetrates in between the iron-based particles by capillary action, disperses uniformly in the particles, reduces particle-to-particle contact resistance and facilitates reorientation of iron-based particles, thus accelerating the enhancement of green density. If the amount of the lower-melting lubricant is less than 10% by mass, the lubricant fails to disperse uniformly in the iron-based particles and the green compact exhibits poor density. If the amount of the lower-melting lubricant is more than 75% by mass, molten lubricant is squeezed toward the surface of a die as the density of the green compact is increased so that passages are provided on the surface of the green compact for the molten lubricant to escape. The passages produce voids on the surface of the green compact, that cause the resultant compact to exhibit insufficient mechanical strength.

The higher-melting lubricant contained in the iron-based powder mixture is present in a solid state at the time compacting is performed. This lubricant acts as "a roller" on the surface protrusions of iron-based particles where it repels molten lubricant, and promotes particle reorientation and enhances the density of the green compact.

The higher-melting lubricant contained in the iron-based powder mixture is preferably a member selected from the group consisting of metallic soap, thermoplastic resin, thermoplastic elastomer, and an organic or inorganic lubricant having a layer crystal structure. Suitable examples are chosen from the following lubricants depending upon the compacting temperature used.

As the metallic soap, zinc stearate, lithium stearate, lithium hydroxystearate or the like is preferred. As the thermoplastic resin, polystyrene, polyamide, fluorine resin or the like is preferred. As the thermoplastic elastomer, polyethylene elastomer, polyamide elastomer or the like is preferred. As the inorganic lubricant of a layer crystal structure, graphite, $MoS_2$ or carbon fluoride is preferred, and finer particle sizes are more effective for reducing the amount of the ejection force. As the organic lubricant of a lamellar crystal structure, melamine-cyanuric acid adduct (MCA) or N-alkyl aspartate-β-alkyl ester is preferred.

The lower-melting lubricant contained in the iron-based powder mixture is preferably a member selected from the group consisting of metallic soap, amide wax, polyethylene, and an eutectic mixture of at least two members thereof. Suitable examples are chosen from the following lubricants depending upon the compacting temperature used.

As the metallic soap, zinc stearate, calcium stearate or the like is preferred. As the amide wax, ethylene bis-stearoamide, monoamide stearate or the like is preferred. As the eutectic mixture, ethylene bis-stearoamide-polyethylene eutectic, ethylene bis-stearoamide-zinc stearate eutectic, ethylene bis-stearoamide-calcium stearate eutectic or the like is preferred. Though dependent upon the compacting temperature used, some of these lower-melting lubricants may be utilized as higher-melting lubricants.

Graphite can be used as an alloying powder in the iron-based powder mixture. This graphite powder is effective to reinforce a sintered compact to be produced, but if the amount used is too great, green density will significantly decrease. Hence, the content of graphite should preferably be less than 0.5% by mass based on the total amount of the iron-based powder mixture.

In the present invention, the high-density iron-based green compact formed by the above-specified production process can be further sintered, to obtain a high-density iron-based sintered compact. Here, any conventional sintering method can be used without limitation. Sinter hardening can also be used to effect rapid cooling after sintering to enhance the strength.

The present invention may be more fully understood with reference to the following examples.

EXAMPLE 1

A partially alloyed steel powder of a Fe-4Ni-0.5Mo-1.5Cu composition derived by diffusion bonding Ni, Mo and Cu to a pure atomized iron powder was used as an iron-based powder. Iron-based powder mixtures were prepared by mixing this alloyed steel powder with 0.5% by mass of a graphite powder and various lubricants shown in Table 1. The mixing was effected with heat and by use of a high-speed mixer.

First, a die for compacting was preheated at each of the temperatures listed in Table 1. A die lubricant for warm compaction with die lubrication electrically charged by a die lubricating system (manufactured by Gasbarre Co.) was jetted into the die and applied to the die surface by electrical charging. The die lubricant was prepared by choosing a lower-melting lubricant and a higher-melting lubricant from among the lubricants shown in Table 2, and then by formulating both lubricants as shown in Table 1. The temperature measured on the die surface was taken as a compacting temperature.

Subsequently, the as-treated die was filled with a heated iron-based powder mixture, followed by compacting, whereby a rectangular green compact with a size of 10×10×55 mm was produced. The pressure loading was 686 MPa, and other compacting conditions were as listed in Table 1. A lubricant contained in the iron-based powder mixture was prepared by choosing a lower-melting lubricant and a higher-melting lubricant from among the lubricants listed in Table 2, and then by formulating both lubricants as shown in Table 1.

As a conventional example, a similar rectangular green compact (Green Compact No. 38) was formed in the same manner as in Example 1 except that a die was not coated with a die lubricant.

After completion of the compacting, the ejection force was measured.

With regard to each green compact thus formed, the density was determined by Archimedes' principle. The principle noted here denotes a method by which the density of a test specimen, each green compact in this case, is determined by measuring the volume of the product after immersion in ethyl alcohol. Additionally, visual inspection was made of the appearance of the green compact to find faults such as marring, breakage and the like. The green compact was centrally cut, embedded in resin and then abraded, followed by examination of voiding in section on a light microscope.

The ejection force, density, appearance and sectional structure of the green compact are tabulated in Table 1.

All of the green compacts of this invention exhibit an ejection force after compacting that is 20 MPa or less and a density that is 7.4 $Mg/m^3$ or greater. Furthermore, these compacts are free of surface oxidation due to heating as well as faults such as marring, breakage and the like. The sectional structures are normal and free of coarse voids.

The comparative and conventional examples that fall outside the scope of the invention revealed a high ejection force exceeding 20 MPa, a low density of less than 7.35 $Mg/m^3$, or coarse voids near to the sectional surface of the green compact.

Advantageously, the present invention can form a high-density green compact that exhibits superior appearance and sectional structure and low ejection force.

EXAMPLE 2

The following six different powders were used as iron-based powders; namely (1) a partially alloyed steel powder a of a Fe-4Ni-0.5Mo-1.5Cu composition derived by diffusion bonding Ni, Mo and Cu to a pure atomized iron powder, (2) a partially alloyed steel powder b of a Fe-2Ni-1Mo composition derived by diffusion bonding Ni and Mo to a pure atomized iron powder, (3) a prealloyed steel powder c of a Fe-3Cr-0.3Mo-0.3V composition derived by prealloying Cr, Mo and V, (4) a prealloyed steel powder d of a Fe-1Cr-0.3Mo-0.3V composition derived by prealloying Cr, Mo and V, (5) an atomized iron powder e, and (6) a reduced iron powder f. The atomized iron powder denotes an iron-based powder resulting from atomization of molten steel with high-pressure water, and the reduced iron powder denotes an iron-based powder resulting from reduction of iron oxide.

The partially alloyed steel powder a, partially alloyed steel powder b, prealloyed steel powder c, prealloyed steel powder d atomized iron powder e and reduced iron powder f were each mixed with graphite in the contents shown in Table 3 and with the lubricants shown in Table 3, whereby iron-based powder mixtures were prepared. The mixing was effected with heat and by use of a high-speed mixer. In case of the atomized iron powder e and reduced iron powder f, 0.8% by mass of graphite and 2.0% by mass of a Cu powder were mixed. The content of graphite is by a mass ratio relative to the total amount of iron-based powder and graphite, or of iron-based powder, graphite and alloy powder.

First, a die for compacting was preheated at each of the temperatures listed in Table 3. A die lubricant for warm compaction with die lubrication electrically charged by a die lubricating system (manufactured by Gasbarre Co.) was jetted into the die and applied to the die surface by means of electrical charging. The die lubricant for warm compaction with die lubrication was prepared by choosing a lower-melting lubricant and a higher-melting lubricant from among the lubricants shown in Table 2, and then by formulating both lubricants as shown in Table 3. The temperature measured on the die surface was taken as a compacting temperature.

Secondly, the die thus treated was filled with a heated iron-based powder mixture, followed by compacting, whereby a rectangular green compact with a size of 10×10×55 mm was produced. The pressure loading was 686 MPa, and other compacting conditions were as listed in Table 3. A lubricant contained in the iron-based powder mixture was prepared by choosing a lower-melting lubricant and a higher-melting lubricant from among the lubricants listed in Table 2, and then by formulating both lubricants as shown in Table 3.

With regard to each iron-based green compact thus obtained, the density was determined by Archimedes' principle as in Example 1.

Subsequently, the iron-based green compact was sintered in a $N_2$-10%$H_2$ atmosphere and at 1,130° C. for 20 minutes, whereby an iron-based sintered compact was formed. The density of the sintered compact was determined by Archimedes' principle. This compact was then machined to obtain a sample in the shape of a small round rod dimensioned to be 5 mm in parallel plane diameter and 15 mm in length. The sample was used to measure tensile strength.

Similar rectangular green compacts were formed in the same manner as in Example 2, except that a die was not coated with a die lubricant. Each green compact was further sintered as in Example 2 to form an iron-based sintered compact which was taken as a conventional example.

The Test Results are Tabulated in Table 3

The present invention provides high density and great tensile strength in contrast to the conventional examples (Sintered Compacts Nos. 2 to 12).

TABLE 1

| | Die lubricants | | | | Lubricants in powdered iron-based mixtures | | | | |
|---|---|---|---|---|---|---|---|---|---|
| | Lubricant of higher melting point than compacting temperature | | Lubricant of lower melting point than compacting temperature | | | Lubricant of higher melting point than compacting temperature | | Lubricant of lower melting point than compacting temperature | |
| Green compact Nos. | Content* mass % | Kind (melting point) | Content* mass % | Kind (melting point) | Lubricant content** mass % | Kind (melting point): Content by mass %*** | Content* mass % | Kind (melting point): Content by mass %*** | Content* mass % |
| 1 | 5 | A3(230° C.) | 95 | A1(148 to 155° C.) | 0.050 | A3(230° C.):0.025 | 50 | A1(148 to 155° C.): 0.025 | 50 |
| 2 | 5 | A4(216° C.) | 95 | A2(127° C.) | 0.200 | A3(230° C.):0.150 | 75 | A1(148 to 155° C.): 0.050 | 25 |
| 3 | 5 | E1(240° C.) | 95 | B1(146° C.) | 0.350 | A3(230° C.):0.200 | 57 | C1(147° C.):0.150 | 43 |
| 4 | 10 | E2(260° C. | 90 | A2(127° C.) | 0.150 | A4(216° C.):0.050 | 33 | A2(127° C.):0.100 | 67 |

TABLE 1-continued

| | | | | | | | | | |
|---|---|---|---|---|---|---|---|---|---|
| 5 | 10 | E3(346° C.) | 90 | D1(<147° C.) | 0.050 | A4(216° C.):0.025 | 50 | A1(148 to 155° C.):0.025 | 50 |
| 6 | 10 | F1(to 300° C.) | 90 | D2(<127° C.) | 0.200 | A4(216° C.):0.120 | 60 | C1(147° C.):0.080 | 40 |
| 7 | 20 | F2(200 to 230° C.) | 80 | D3(<147° C.) | 0.400 | A3(230° C.):0.100 | 25 | C1(147° C.):0.100 A1(148 to 155° C.):0.150 | 75 |
| 8 | 20 | G1(>200° C.) | 80 | C1(147° C.) | 0.150 | A3(230° C.):0.100 | 67 | A2(127° C.):0.025 A1(148 to 155° C.):0.025 | 33 |
| 9 | 20 | G2(>200° C.) | 80 | A2(127° C.) | 0.050 | A3(230° C.):0.020 | 40 | A2(127° C.):0.015 C1(147° C.):0.015 | 60 |
| 10 | 25 | G3(>200° C.) | 75 | A1(148 to 155° C.) | 0.200 | A3(230° C.):0.100 | 50 | A1(148 to 155° C.):0.025 A2(127° C.):0.050 C1(147° C.):0.025 | 50 |
| 11 | 25 | H1>200° C.) | 75 | B1(146° C.) | 0.350 | A4(216° C.):0.100 | 29 | A1(148 to 155° C.): 0.150 C(147° C.):0.100 | 71 |
| 12 | 25 | H2(>200° C.) | 75 | C1(147° C.) | 0.150 | A4(216° C.):0.100 | 67 | A1(148 to 155° C.):0.025 A2 (127° C.):0.025 | 33 |
| 13 | 30 | A3(230° C.) | 70 | A2(127° C.) | 0.400 | A4(216° C.):0.100 | 25 | C2(100° C.):0.200 A2(127° C.):0.100 | 75 |
| 14 | 30 | A3(230° C.) | 70 | A2(127° C.) | 0.150 | A4(216° C.):0.010 A1(150° C.):0.005 C1(147° C.):0.015 | 70 | A2(127° C.):0.015 | 30 |
| 15 | 30 | A3(230° C.) | 70 | C2(100° C.) | 0.400 | A3(230° C.):0.100 A4(216° C.):0.100 A1(148 to 155° C.):0.050 C1(147° C.):0.050 | 75 | A2(127° C.):0.100 | 25 |
| 16 | 35 | A3(230° C.) | 65 | A2(127° C.) | 0.400 | A3(230° C.):0.100 A4(216° C.):0.100 | 50 | A2(127° C.):0.100 C2(100° C.):0.100 | 50 |
| 17 | 35 | A4(216° C.) | 65 | D2(<127° C.) | 0.050 | A3(230° C.):0.025 | 50 | A2(127° C.):0.025 | 50 |
| 18 | 35 | A4(216° C.) | 65 | A(150° C.)35 D3 (<147° C.)30 | 0.200 | A3(230° C.):0.150 | 75 | A1(148 to 155° C.):0.050 | 25 |
| 19 | 40 | A4(216° C.) | 60 | B1(146° C.) | 0.350 | A3(230° C.):0.200 | 57 | C1(147° C.):0.150 | 43 |
| 20 | 40 | A4(216° C.)20 E1(240° C.)20 | 60 | C1(147° C.) | 0.150 | A4(216° C.):0.040 | 27 | A2(127° C.):0.110 | 73 |
| 21 | 40 | A4(216° C.)20 E2(260° C.)20 | 60 | D1(<146° C.) | 0.050 | A4(216° C.):0.025 | 50 | A1(148 to 155° C.): 0.025 | 50 |
| 22 | 40 | A4(216° C.)20 E3(346° C.)20 | 60 | D2(<127° C.) | 0.200 | A4(216° C.):0.120 | 60 | C1(147° C.)0.080 | 40 |
| 23 | 40 | F1(300° C.)20 A4(216' C.)20 | 60 | D3(<146° C.) | 0.350 | A3(230° C.):0.150 | 43 | A1(148 to 155° C.):0.100 C1(147° C.):0.100 | 33 |
| 24 | 45 | E2(260° C.)20 G1(>200° C.) 25 | 55 | A1(148 to 155° C.) | 0.150 | A3(230° C.):0.100 | 67 | A1(148 to 155° C.):0.025 A2(127° C.):0.025 | 33 |
| 25 | 50 | E2(260° C.)25 H1(>200° C.) | 50 | A2(127° C.) | 0.050 | A3(230° C.):0.020 | 40 | C1(147° C.):0.015 A2(127° C.):0.015 | 60 |
| 26 | 50 | A3(230° C.)25 E2(260° C.)25 | 50 | B1(146° C.) | 0.200 | A3(230° C.):0.100 | 50 | A1(148 to 155° C.):0.025 A2(127° C.):0.050 C1(147° C.):0.025 | 50 |
| 27 | 50 | A4(216° C.)20 E2(260° C.)20 F1(300° C.)10 | 50 | D1(<146° C.) | 0.350 | A4(216° C.):0.100 | 29 | A1(148 to 155° C.):0.150 C1(147° C.):0.100 | 71 |
| 28 | 2 | E2(260° C.) | 98 | D2(<127° C.) | 0.100 | A4(216° C.):0.050 | 50 | A1(148° C. to 155° C.):0.025 A2(127° C.):0.025 | 50 |
| 29 | 2 | E2(260° C.) | 98 | D3(<146° C.) | 0.400 | A4(216° C.):0.100 | 25 | C1(147° C.):0.200 A2(127° C.):0.100 | 75 |
| 30 | 10 | A3(230° C.) | 90 | A1(148 to 155° C. | — | — | — | — | — |
| 31 | 10 | A3(230° C.) | 90 | B1(146° C.) | 0.600 | A3(230° C.):0.300 | 50 | A2(127° C.):0.300 | 50 |
| 32 | 5 | A3(230° C.) | 98 | C1(147° C.) | 0.150 | A3(230° C.):0.143 | 95 | C1(147° C.):0.0075 | 5 |
| 33 | 75 | A3(230° C.) | 25 | A2(127° C.) | 0.150 | A4(216° C.):0.030 | 20 | C2(100° C.)0.120 | 80 |
| 34 | 0 | — | 100 | A1(148 to 155° C.) | 0.350 | A3(230° C.):0.280 | 80 | A1(148 to 155° C.):0.070 | 20 |
| 35 | 100 | A3(213° C.)90 A1(148 to 155° C.) | 0 | — | 0.200 | A3(230° C.):0.100 | 50 | A2(127° C.):0.100 | 50 |
| 36 | 100 | A3(230° C.)25 A1(148 to 155° C.) | 0 | — | 0.300 | A3(230° C.):0.225 | 75 | A1(148 to 155° C.):0.075 | 25 |

TABLE 1-continued

| | | | | | | | | | |
|---|---|---|---|---|---|---|---|---|---|
| 37 | 0 | — | 100 | A1(148 to 155° C.) A4(216° C.)25 | 0.300 | A3(230° C.):0.225 | 75 | A1(148 to 155° C.):0.075 | 25 |
| 38 | — | — | — | — | 0.600 | A3(230° C.):0.420 | 70 | A1(148 to 155° C.)0.180 | 30 |

| Green compact Nos. | Compacting conditions: Die preheating temperature ° C. | Heating temperature for powdered iron-based mixture ° C. | Compacting temperature ° C. | Green compacts: Ejection force MPa | Density Mg/m$^3$ | Appearance | Sectional structure | Remarks |
|---|---|---|---|---|---|---|---|---|
| 1 | 210 | 150 | 160 | 17 | 7.40 | good | good | Invention |
| 2 | 210 | 150 | 160 | 18 | 7.41 | good | good | Invention |
| 3 | 220 | 155 | 170 | 18 | 7.41 | good | good | Invention |
| 4 | 180 | 120 | 130 | 20 | 7.39 | good | good | Invention |
| 5 | 210 | 145 | 160 | 20 | 7.45 | good | good | Invention |
| 6 | 200 | 135 | 150 | 18 | 7.43 | good | good | Invention |
| 7 | 210 | 145 | 158 | 11 | 7.40 | good | good | Invention |
| 8 | 200 | 140 | 155 | 11 | 7.40 | good | good | Invention |
| 9 | 200 | 135 | 150 | 14 | 7.43 | good | good | Invention |
| 10 | 210 | 150 | 160 | 11 | 7.42 | good | good | Invention |
| 11 | 200 | 145 | 158 | 12 | 7.41 | good | good | Invention |
| 12 | 210 | 155 | 160 | 14 | 7.42 | good | good | Invention |
| 13 | 180 | 115 | 130 | 12 | 7.40 | good | good | Invention |
| 14 | 185 | 125 | 135 | 15 | 7.45 | good | good | Invention |
| 15 | 185 | 120 | 135 | 13 | 7.42 | good | good | Invention |
| 16 | 190 | 130 | 140 | 13 | 7.40 | good | good | Invention |
| 17 | 190 | 130 | 140 | 18 | 7.43 | good | good | Invention |
| 18 | 205 | 140 | 155 | 13 | 7.40 | good | good | Invention |
| 19 | 200 | 135 | 150 | 17 | 7.42 | good | good | Invention |
| 20 | 200 | 135 | 150 | 17 | 7.42 | good | good | Invention |
| 21 | 205 | 140 | 155 | 16 | 7.42 | good | good | Invention |
| 22 | 200 | 135 | 150 | 16 | 7.42 | good | good | Invention |
| 23 | 205 | 145 | 155 | 14 | 7.40 | good | good | Invention |
| 24 | 210 | 150 | 160 | 17 | 7.44 | good | good | Invention |
| 25 | 210 | 150 | 160 | 16 | 7.43 | good | good | Invention |
| 26 | 215 | 155 | 165 | 19 | 7.42 | good | good | Invention |
| 27 | 215 | 155 | 165 | 20 | 7.41 | good | good | Invention |
| 28 | 220 | 160 | 170 | 19 | 7.46 | good | good | Invention |
| 29 | 220 | 160 | 170 | 17 | 7.39 | good | good | Invention |
| 30 | 210 | 145 | 160 | 35 | 7.31 | good | good | Comparative Example |
| 31 | 190 | 125 | 140 | 29 | 7.33 | marred | good | Compartive Example |
| 32 | 190 | 125 | 140 | 31 | 7.34 | marred | good | Compartive Example |
| 33 | 180 | 115 | 130 | 17 | 7.40 | good | void | Compartive Example |
| 34 | 210 | 150 | 160 | 25 | 7.42 | marred | good | Compartive Example |
| 35 | 190 | 125 | 140 | 30 | 7.27 | good | good | Compartive Example |
| 36 | 100 | 50 | 60 | 25 | 7.27 | good | good | Compartive Example |
| 37 | 270 | 210 | 220 | 29 | 7.43 | oxidized | good | Compartive Example |
| 38 | 220 | 160 | 170 | 38 | 7.35 | marred | good | Conventional Example |

*) content ratio to total amount lubricant
**) total content of lubricant in powdered iron-based mixture
***) content in powdered iron-based mixture

TABLE 2

| Symbols | Kinds of lubricants | | Symbols | Kinds of lubricants | |
|---|---|---|---|---|---|
| A1 | Calcium stearate | Metallic soap | E1 | Polystyrene | Thermoplastic resin |
| A2 | Zinc stearate | | E2 | Polyamide(nylon 66) | |
| A3 | Lithium stearate | | E3 | Polytestrafluoroethylene | |
| A4 | Lithium hydroxystearate | | F1 | Polystyrene elastomer | Thermoplasstic elastomer |
| B1 | Straight-chain low-density polyethylene | | F2 | Polyamide elastomer | |
| C1 | Ethylene bis-stearamide | Amids wax | G1 | Graphite | Inorganic lemallar lubricant |
| C2 | Monoamidestearate | | G2 | $MoS_2$ | |
| D1 | Ethylene bis-stearo-amidepolyethylencutectic | Eutactic mixture | G3 | Carbon fluoride | |
| D2 | Ethlene bis-stearoamide-zinc stearate eulectic | | H1 | Melamine-cyanuric acid adduct (MCA) | Organic lamellar lubricant |
| D3 | Ethylene bis-stearamide-calcium stearate entectic | | E2 | N-alkyl aspartate-β-alkyl ester | |

TABLE 3

| Sintered Compact Nos. | Die lubricants: Lubricant of higher melting point than compacting temperature: Content* mass % | Kind (melting point) | Lubricant of lower melting point then compacting temperature: Content* mass % | Kind (melting point) | Kind of iron-based powder | Graphite content in iron-based powder mixture mass % | Lubricants in powdered iron-based mixtures: Lubricant content** mass % | Lubricant of higher melting point than compacting temperature: Kind (melting point): Content by mass %*** | Content* mass % | Lubricant of lower melting point than compacting temperature: Kind (melting point): Content by mass %*** | Content* mass % |
|---|---|---|---|---|---|---|---|---|---|---|---|
| 2-1 | 75 | A3(230° C.) | 25 | A1(148 to 155° C.) | a | 0.6 | 0.20 | A3(230° C.):0.15 | 75 | A1(148 to 155° C.):0.05 | 25 |
| 2-2 | — | — | — | — | a | 0.6 | 0.80 | A3(230° C.):0.60 | 75 | 155° C.):0.20 | |
| 2-3 | 75 | A3(230° C.) | 25 | Al(148 to 155° C.) | b | 0.6 | 0.20 | A3(230° C.):0.15 | 75 | A1(148 to 155° C.):0.05 | 25 |
| 2-5 | 75 | A3(230° C.) | 25 | A2(127° C.) | c | 0.9 | 0.20 | A1(148 to 155° C.):0.05 C1(147° C.):0.05 | 50 | A2(127° C.):0.01 | 50 |
| 2-6 | — | — | — | — | c | 0.9 | 0.80 | A1(148 to 155° C.):0.20 C1(147° C.):0.20 | 50 | A2(127° C.):0.40 | 50 |
| 2-7 | 75 | A3(230° C.) | 25 | a2(127° C.) | d | 0.9 | 0.20 | A1(148 to 155° C.):0.05 C1(147° C.):0.05 | 50 | A2(127° C.):0.10 | 50 |
| 2-8 | — | — | — | — | d | 0.9 | 0.80 | A1(148 to 155° C.):0.20 C1(147° C.):0.20 | | | |
| 2-9 | 75 | A3(230° C.) | 25 | C2(100° C.) | e | 0.8 | 0.20 | 2(230° C.):0.10 | 50 | A2(127° C.):0.05 C2(100° C.):0.05 | |
| 2-10 | — | — | — | — | e | 0.8 | 0.80 | A3(230° C.):0.60 | 75 | A2(127° C.):0.10 C2(100° C.):0.10 | 25 |
| 2-11 | 75 | A3(230° C.) | 25 | C2(100° C.) | f | 0.8 | 0.20 | A3(230° C.):0.10 | 50 | A2(127° C.):0.05 C2(100° C.):0.05 | 50 |
| 2-12 | — | — | — | — | f | 0.8 | 0.80 | A3(230° C.):0.60 | 75 | A2(127° C.):0.10 C2(100° C.):0.10 | 25 |
| 2-13 | 75 | A3(230° C.) | 25 | A1(148 to 155° C.) | a | 0.8 | 0.20 | A3(230° C.):0.15 | 75 | A1(148 to 155° C.):0.05 | 25 |

| Sintered Compact Nos. | Compacting conditions: Die preheating temperature ° C. | Heating temperature for powdered iron-based mixture ° C. | Compacting temperature ° C. | Green compacts: Density Mg/m$^2$ | Sintered Compacts: Density Mg/m$^2$ | Tensile strength MPa | Remarks |
|---|---|---|---|---|---|---|---|
| 2-1 | 210 | 150 | 160 | 7.42 | 7.40 | 830 | Invention |
| 2-2 | 210 | 150 | 160 | 7.32 | 7.31 | 740 | Conventional Example |
| 2-3 | 210 | 150 | 160 | 7.42 | 7.43 | 710 | Invention |
| 2-4 | 210 | 150 | 160 | 7.33 | 7.34 | 640 | Conventional Example |
| 2-5 | 185 | 120 | 135 | 7.23 | 7.22 | 810 | Invention |
| 2-6 | 185 | 120 | 135 | 7.13 | 7.12 | 720 | Conventional Example |
| 2-7 | 185 | 120 | 135 | 7.33 | 7.32 | 850 | Invention |
| 2-8 | 185 | 120 | 135 | 7.25 | 7.23 | 760 | Conventional Example |
| 2-9 | 170 | 115 | 130 | 7.36 | 7.23 | 620 | Invention |
| 2-10 | 170 | 115 | 130 | 7.27 | 7.14 | 530 | Conventional Example |
| 2-11 | 170 | 115 | 130 | 7.25 | 7.14 | 680 | Invention |
| 2-12 | 170 | 115 | 130 | 7.16 | 7.05 | 590 | Conventional Example |
| 2-13 | 210 | 150 | 160 | 7.40 | 7.39 | 820 | Invention |

EXAMPLE 3

A partially alloyed steel powder of a Fe-4Ni-0.5Mo-1.5Cu composition derived by diffusion bonding Ni, Mo and Cu to a pure atomized iron powder was used as an iron-based powder. Iron-based powder mixtures were prepared by mixing this alloyed steel powder with 0.2% by mass of a graphite powder and various lubricants shown in Table 3. The mixing was effected with heat and by use of a high-speed mixer.

First, a die for compacting was preheated at each of the temperatures listed in Table 4. A die lubricant electrically charged by a die lubricating system (manufactured by Gasbarre Co.) was jetted into the die and applied to the die surface by means of electrical charging. The die lubricant was prepared by choosing a lower-melting lubricant and a higher-melting lubricant from among the lubricants shown in Table 2, and then by formulating both lubricants as shown in Table 4. The temperature measured on the die surface was taken as a compacting temperature.

Subsequently, the die thus treated was filled with a heated iron-based powder mixture, followed by compacting, whereby a rectangular green compact with a size of 10×10×55 mm was produced. The pressure loading was 686 MPa, and other compacting conditions were as listed in Table 4. A lubricant contained in the iron-based powder mixture was prepared by choosing a lower-melting lubricant and a higher-melting lubricant from among the lubricants listed in Table 2, and then by formulating both lubricants as shown in Table 4.

As a conventional example, a similar rectangular green compact (Green Compact No. 38) was formed in the same manner as in Example 4 except that a die was not coated with a die lubricant.

After completion of the compacting, the ejection force was measured.

With regard to each of the resultant green compacts, the density was determined by Archimedes' principle. Visual inspection was then made of the appearance of the green compact to find faults such as marring, breakage and the like. The green compact was centrally cut, embedded in resin and then abraded, followed by examination of voiding in section on a light microscope.

The ejection force, density, appearance and sectional structure of the green compact are tabulated in Table 4.

All the green compacts according to this invention exhibit an ejection force after compacting that is 20 MPa or less and a density that is 7.43 $Mg/m^3$ or greater. In addition, each such green compact suffers neither surface oxidation resulting from heating nor faults such as marring, breakage and the like. The sectional structure is normal with the absence of coarse voids.

The comparative and conventional examples that depart from the scope of the invention suffered a high ejection force exceeding 20 MPa, a low density of less than 7.39 $Mg/m^3$, or coarse voids near to the sectional surface of the green compact.

The present invention is highly advantageous in that a high-density green compact is obtainable with superior appearance and sectional structure as well as low ejection force.

TABLE 4

| | Die lubricants | | | | Lubricants in powdered iron-based mixtures | | | | |
|---|---|---|---|---|---|---|---|---|---|
| | Lubricant of higher melting point than compacting temperature | | Lubricant of lower melting point than compacting temperature | | | Lubricant of higher melting point than compacting temperature | | Lubricant of lower melting point than compacting temperature | |
| Green compact Nos. | Content* mass % | Kind (melting point) | Content* mass % | Kind (melting point) | Lubricant content** mass % | Kind (melting point): Content by mass %*** | Content* mass % | Kind (melting point): Content by mass %*** | Content* mass % |
| 1 | 2 | A3(230° C.) | 98 | A1(148 to 155° C.) | 0.050 | A3(230° C.):0.025 | 50 | A1(148 to 155° C.): 0.025 | 50 |
| 2 | 5 | A4(216° C.) | 95 | A2(127° C.) | 0.150 | A3(230° C.):0.100 | 67 | A1(148 to 155° C.): 0.050 | 33 |
| 3 | 5 | E1(240° C.) | 95 | B1(146° C.) | 0.350 | A3(230° C.):0.200 | 57 | C1(147° C.):0.150 | 43 |
| 4 | 10 | E2(260° C. | 90 | A2(127° C.) | 0.150 | A4(216° C.):0.050 | 33 | A2(127° C.):0.100 | 67 |
| 5 | 10 | E3(346° C.) | 90 | D1(<147° C.) | 0.050 | A4(216° C.):0.025 | 50 | A1(148 to 155° C.):0.025 | 50 |
| 6 | 15 | F1(300° C.) | 85 | D2(<127° C.) | 0.200 | A4(216° C.):0.120 | 60 | C1(147° C.):0.080 | 40 |
| 7 | 20 | F2(200 to 230° C.) | 80 | D3(<147° C.) | 0.400 | A3(230° C.):0.100 | 25 | C1(147° C.):0.150<br>A1(148 to 155° C.):0.150 | 75 |
| 8 | 10 | G1(>200° C.) | 90 | C1(147° C.) | 0.150 | A3(230° C.):0.100 | 67 | A2(127° C.):0.025<br>A1(148 to 155° C.):0.025 | 33 |
| 9 | 20 | G2(>200° C.) | 80 | A2(127° C.) | 0.200 | A3(230° C.):0.080 | 40 | A2(127° C.):0.060<br>C1(147° C.):0.060 | 60 |
| 10 | 20 | G3(>200° C.) | 80 | A1(148 to 155° C.) | 0.200 | A3(230° C.):0.100 | 50 | A1(148 to 155° C.):0.025<br>A2(127° C.):0.050<br>C1(147° C.):0.025 | 50 |
| 11 | 25 | H1>200° C.) | 75 | B1(146° C.) | 0.200 | A4(216° C.):0.100 | 50 | A1(148 to 155° C.): 0.060<br>C(147° C.):0.040 | 50 |
| 12 | 50 | H1>200° C.) | 50 | C1(147° C.) | 0.150 | A4(216° C.):0.100 | 67 | A1(148 to 155° C.):0.025<br>A2 (127° C.):0.025 | 33 |
| 13 | 30 | A3(230° C.) | 70 | A2(127° C.) | 0.400 | A4(216° C.):0.100 | 25 | C2(100° C.):0.200<br>A2(127° C.):0.100 | 75 |
| 14 | 60 | A3(230° C.) | 40 | A2(127° C.) | 0.150 | A4(216° C.):0.030<br>A1(150° C.):0.015<br>C1(147° C.):0.045 | 67 | A2(127° C.):0.045 | 33 |

TABLE 4-continued

| | | | | | | | | | |
|---|---|---|---|---|---|---|---|---|---|
| 15 | 30 | A3(230° C.) | 70 | C2(100° C.) | 0.400 | A3(230° C.):0.100<br>A4(216° C.):0.100<br>A1(148 to<br>155° C.):0.050<br>C1(147° C.):0.050 | 75 | A2(127° C.):0.100 | 25 |
| 16 | 35 | A3(230° C.) | 65 | A2(127° C.) | 0.200 | A3(230° C.):0.050<br>A4(216° C.):0.050 | 50 | A2(127° C.):0.050<br>C2(100° C.):0.050 | 50 |
| 17 | 35 | A4(216° C.) | 65 | D2(<127° C.) | 0.150 | A3(230° C.):0.125 | 83 | A2(127° C.):0.025 | 17 |
| 18 | 35 | A4(216° C.) | 65 | A1(150° C.)35<br>D3<br>(<147° C.)30 | 0.200 | A3(230° C.):0.150 | 75 | A1(148 to<br>155° C.):0.050 | 25 |
| 19 | 60 | A4(216° C.) | 40 | B1(146° C.) | 0.350 | A3(230° C.):0.200 | 57 | C1(147° C.):0.150 | 43 |
| 20 | 40 | A4(216° C.)20<br>E1(240° C.)2 | 60 | C1(147° C.) | 0.150 | A4(216° C.):0.040 | 27 | A2(127° C.):0.110 | 73 |
| 21 | 40 | A4(216° C.)20<br>E2(260° C.)20 | 60 | D1(<146° C.) | 0.150 | A4(216° C.):0.100 | 67 | A1(148 to<br>155° C.): 0.050 | 33 |
| 22 | 40 | A4(216° C.)20<br>E3(346° C.)20 | 60 | D2(<127° C.) | 0.200 | A4(216° C.):0.080 | 40 | C1(147° C.)0.120 | 60 |
| 23 | 50 | F1(300° C.)25<br>A4(216' C.)25 | 50 | D3(<146° C.) | 0.350 | A3(230° C.):0.150 | 43 | A1(148 to<br>155° C.):0.100<br>C1(147° C.):0.100 | 57 |
| 24 | 50 | E2(260° C.)25<br>G1(>200° C.)<br>25 | 50 | A1(148 to<br>155° C.) | 0.150 | A3(230° C.):0.100 | 67 | A1(148 to<br>155° C.):0.025<br>A2(127° C.):0.025 | 33 |
| 25 | 60 | E2(260° C.)30<br>H1(>200° C.)<br>30 | 40 | A2(127° C.) | 0.050 | A3(230° C.):0.020 | 40 | C1(147° C.):0.015<br>A2(127° C.):0.015 | 60 |
| 26 | 70 | A3(230° C.)35<br>E2(260° C.)35 | 30 | B1(146° C.) | 0.200 | A3(230° C.):0.100 | 50 | A1(148 to<br>155° C.):0.025<br>A2(127° C.):0.050<br>C1(147° C.):0.025 | 50 |
| 27 | 80 | A4(216° C.)30<br>E2(260° C.)30<br>F1(300° C.)20 | 20 | D1(<146° C.) | 0.350 | A4(216° C.):0.100 | 29 | A1(148 to<br>155° C.):0.150<br>C1(147° C.):0.100 | 71 |
| 28 | 2 | E2(260° C.) | 98 | D2(<127° C.) | 0.200 | A4(216° C.):0.100 | 50 | A1(148° C. to<br>155° C.):0.050<br>A2(127° C.):0.050 | 50 |
| 29 | 2 | E2(260° C.) | 98 | D3(<146° C.) | 0.400 | A4(216° C.):0.100 | 25 | C1(147° C.):0.200<br>A2(127° C.):0.100 | 75 |
| 30 | 10 | A3(230° C.) | 90 | A1(148 to<br>155° C. | — | — | — | — | — |
| 31 | 10 | A3(230° C.) | 90 | B1(146° C.) | 0.600 | A3(230° C.):0.300 | 50 | A2(127° C.):0.300 | 50 |
| 32 | 5 | A3(230° C.) | 95 | C1(147° C.) | 0.150 | A3(230° C.):0.143 | 95 | C1(147° C.):0.0075 | 5 |
| 33 | 90 | A3(230° C.) | 10 | A2(127° C.) | 0.150 | A4(216° C.):0.030 | 20 | C2(100° C.)0.120 | 80 |
| 34 | 0 | — | 100 | A1(148 to<br>155° C.) | 0.300 | A3(230° C.):0.200 | 67 | A1(148 to<br>155° C.):0.010 | 33 |
| 35 | 100 | A3(213° C.)90<br>A1(148 to<br>155° C.) | 0 | — | 0.200 | A3(230° C.):0.100 | 50 | A2(127° C.):0.100 | 50 |
| 36 | 100 | A3(230° C.)25<br>A1(148 to<br>155° C.) | 0 | — | 0.300 | A3(230° C.):0.225<br>A1(148 to<br>155° C.):0.075 | 100 | — | 0 |
| 37 | 0 | — | 100 | A1(148 to<br>155° C.)<br>A4(216° C.)25 | 0.300 | A3(230° C.):0.225 | 75 | A1(148 to<br>155° C.):0.075 | 25 |
| 38 | — | — | — | — | 0.600 | A3(230° C.):0.420 | 70 | A1(148 to<br>155° C.)0.180 | 30 |

| Green compact Nos. | Compacting conditions: Die preheating temperature ° C. | Heating temperature for powdered iron-based mixture ° C. | Compacting temperature ° C. | Green compacts: Ejection force MPa | Density Mg/m$^3$ | Appearance | Sectional structure | Remarks |
|---|---|---|---|---|---|---|---|---|
| 1 | 190 | 150 | 160 | 17 | 7.44 | good | good | Invention |
| 2 | 190 | 150 | 160 | 18 | 7.45 | good | good | Invention |
| 3 | 180 | 140 | 150 | 17 | 7.44 | good | good | Invention |
| 4 | 160 | 120 | 130 | 20 | 7.43 | good | good | Invention |
| 5 | 190 | 145 | 160 | 20 | 7.48 | good | good | Invention |
| 6 | 180 | 135 | 150 | 18 | 7.47 | good | good | Invention |
| 7 | 190 | 145 | 158 | 11 | 7.45 | good | good | Invention |
| 8 | 185 | 140 | 155 | 12 | 7.44 | good | good | Invention |
| 9 | 180 | 135 | 150 | 14 | 7.47 | good | good | Invention |
| 10 | 190 | 150 | 160 | 12 | 7.45 | good | good | Invention |
| 11 | 190 | 145 | 158 | 14 | 7.45 | good | good | Invention |
| 12 | 190 | 155 | 160 | 13 | 7.46 | good | good | Invention |
| 13 | 160 | 120 | 130 | 12 | 7.45 | good | good | Invention |
| 14 | 165 | 125 | 135 | 14 | 7.49 | good | good | Invention |

TABLE 4-continued

| | | | | | | | | |
|---|---|---|---|---|---|---|---|---|
| 15 | 160 | 120 | 130 | 13 | 7.46 | good | good | Invention |
| 16 | 170 | 130 | 140 | 15 | 7.45 | good | good | Invention |
| 17 | 170 | 130 | 140 | 18 | 7.47 | good | good | Invention |
| 18 | 190 | 140 | 155 | 14 | 7.44 | good | good | Invention |
| 19 | 180 | 135 | 150 | 17 | 7.46 | good | good | Invention |
| 20 | 180 | 135 | 150 | 17 | 7.46 | good | good | Invention |
| 21 | 190 | 140 | 155 | 15 | 7.46 | good | good | Invention |
| 22 | 180 | 135 | 150 | 16 | 7.45 | good | good | Invention |
| 23 | 190 | 145 | 155 | 14 | 7.44 | good | good | Invention |
| 24 | 190 | 150 | 160 | 17 | 7.48 | good | good | Invention |
| 25 | 180 | 140 | 150 | 16 | 7.47 | good | good | Invention |
| 26 | 190 | 155 | 165 | 18 | 7.46 | good | good | Invention |
| 27 | 190 | 155 | 165 | 19 | 7.45 | good | good | Invention |
| 28 | 200 | 160 | 170 | 19 | 7.49 | good | good | Invention |
| 29 | 200 | 160 | 170 | 17 | 7.43 | good | good | Invention |
| 30 | 190 | 145 | 160 | 35 | 7.35 | good | good | Comparative Example |
| 31 | 180 | 125 | 150 | 29 | 7.36 | marred | good | Compartive Example |
| 32 | 180 | 125 | 150 | 31 | 7.38 | marred | good | Compartive Example |
| 33 | 160 | 115 | 130 | 23 | 7.42 | good | void | Compartive Example |
| 34 | 190 | 150 | 160 | 25 | 7.44 | marred | good | Compartive Example |
| 35 | 170 | 125 | 140 | 30 | 7.31 | good | good | Compartive Example |
| 36 | 100 | 60 | 70 | 25 | 7.31 | good | good | Compartive Example |
| 37 | 250 | 210 | 220 | 30 | 7.47 | oxidized | good | Compartive Example |
| 38 | 200 | 160 | 170 | 38 | 7.38 | marred | good | Conventional Example |

*) content ratio to total amount lubricant
**) total content of lubricant in powdered iron-based mixture
***) content in powdered iron-based mixture

EXAMPLE 4

The following two different powders were used as iron-based powders; namely (1) a partially alloyed steel powder a of a Fe-4Ni-0.5Mo-1.5Cu composition derived by diffusion bonding Ni, Mo and Cu to a pure atomized iron powder, and (2) a prealloyed steel powder b of a Fe-3Cr-0.3Mo-0.3V composition derived by prealloying Cr, Mo and V.

The partially alloyed steel powder a, and prealloyed steel powder b were mixed with graphite in the contents shown in Table 5 and the lubricants shown in Table 5, whereby iron-based powder mixtures were prepared. The mixing was effected with heat and by use of a high-speed mixer. The content of graphite is by a mass ratio relative to the total amount of the iron-based powder mixture.

First, a die was preheated at each of the temperatures listed in Table 5. A die lubricant for electrically charged by a die lubricating system (manufactured by Gasbarre Co.) was jetted into the die and applied to the die surface by means of electrical charging. The die lubricant was prepared by choosing a lower-melting lubricant and a higher-melting lubricant from among the lubricants shown in Table 2, and then by formulating both lubricants as shown in Table 5. The temperature measured on the die surface was taken as a compacting temperature.

Secondly, the die thus treated was filled with a heated iron-based powder mixture, followed by compacting, whereby a rectangular green compact with a size of 10×10×55 mm was produced. The pressure loading was 686 MPa, and other compacting conditions were as listed in Table 5.

A lubricant contained in the iron-based powder mixture was prepared by choosing a lower-melting lubricant and a higher-melting lubricant from among the lubricants listed in Table 2, and then by formulating both lubricants as shown in Table 5.

With regard to each iron-based green compact thus obtained, the density was determined by Archimedes' principle as in Example 1.

Subsequently, the iron-based powder green compact was sintered in a $N_2$-10%$H_2$ atmosphere and at 1,130° C. for 20 minutes, whereby an iron-based sintered compact was formed. The density of the resultant sintered compact was determined by Archimedes' principle. The test results are tabulated in Table 5. The examples of the invention provides high densities.

As stated above, the present invention is significantly advantageous in that a high-density green compact can be produced with superior appearance and sectional structure and by single pressing. Ejection of the compact from the associated die is possible at a low force with a prolonged lifetime of the die. Also notably, a high-density sintered compact is easy to produce.

TABLE 5

| Sintered Compact Nos. | Die lubricants: Lubricant of higher melting point than compacting temperature: Content* mass % | Kind (melting point) | Lubricant of lower melting point than compacting temperature: Content* mass % | Kind (melting point) | Kind of iron-based powder | Graphite content in iron-based powder mixture mass % | Lubricants inpowdered iron-based mixtures: Lubricant content** mass % | Lubricant of higher melting point than compacting temperature: Kind (melting point): Content by mass %*** | Content* mass % | Lubricant of lower melting point than compacting temperature: Kind (melting point): Content by mass %*** | Content* mass % |
|---|---|---|---|---|---|---|---|---|---|---|---|
| 2-1 | 75 | A3(230° C.) | 25 | A1(148 to 155° C.) | a | 0.15 | 0.15 | A3(230° C.):0.1 | 67 | A1(148 to 155° C.): 0.025 A2(127° C.):0.025 | 33 |
| 2-2 | 75 | A3(230° C.) | 25 | A1(148 to 155° C.) | a | 0.30 | 0.15 | A3(230° C.):0.1 | 67 | A1(148 to 155° C.): 0.025 A2(127° C.):0.025 | 33 |
| 2-3 | 75 | A3(230° C.) | 25 | A1(148 to 155° C.) | a | 0.45 | 0.15 | A3(230° C.):0.1 | 67 | A1(148 to 155° C.): 0.025 A2(127° C.):0.025 | 33 |
| 2-4 | 75 | A3(230° C.) | 25 | A1(148 to 155° C.) | a | 0.55 | 0.15 | A3(230° C.):0.1 | 67 | A1(148 to 155° C.): 0.025 A2(127° C.):0.025 | 33 |
| 2-5 | 75 | A3(230° C.) | 25 | A2(127° | b | 0.15 | 0.20 | A1(148 to 155° C.):0.05 C1(147° C.):0.05 | 50 | A2(127° C.):0.010 | 50 |
| 2-6 | 75 | A3(230° C.) | 25 | A1(127 | b | 0.30 | 0.20 | A1(148 to 155° C.):0.05 C1(147° C.):0.05 | 50 | A2(127° C.):0.010 | 50 |
| 2-7 | 75 | A3(230° C.) | 25 | A1(127 | b | 0.45 | 0.20 | A1(148 to 155° C.):0.05 C1(147° C.):0.05 | 50 | A2(127° C.):0.010 | 50 |
| 2-8 | 75 | A3(230° C.) | 25 | A1(127 | b | 0.55 | 0.20 | A1(148 to 155° C.):0.05 C1(147° C.):0.05 | 50 | A2(127° C.):0.010 | 50 |

| Sintering compact Nos. | Compacting conditions: Die preheating temperature ° C. | Heating temperature for powdered mixture ° C. | Compacting temperature ° C. | Green compacts Density Mg/m$^3$ | Sintered compacts Density Mg/m$^3$ | Remarks |
|---|---|---|---|---|---|---|
| 2-1 | 190 | 150 | 160 | 7.49 | 7.47 | Invention |
| 2-2 | 190 | 150 | 160 | 7.47 | 7.45 | Invention |
| 2-3 | 190 | 150 | 160 | 7.45 | 7.43 | Invention |
| 2-4 | 190 | 150 | 160 | 7.39 | 7.38 | Compartive Example |
| 2-5 | 165 | 120 | 135 | 7.34 | 7.34 | Invention |
| 2-6 | 165 | 120 | 135 | 7.32 | 7.32 | Invention |
| 2-7 | 165 | 120 | 135 | 7.30 | 7.29 | Invention |
| 2-8 | 165 | 120 | 135 | 7.25 | 7.24 | Compartive Example |

*) content ratio to total amount lubricant
**) total content of lubricant in powdered iron-based mixture
***) content in powdered iron-based mixture
Note: Cross-refer to Table 2 as to the lubricant symbols.

What is claimed is:

1. A die lubricant for warm compaction with die lubrication, comprising a mixture including:

a first lubricant having a melting point that is higher than a preset compacting temperature; and a second lubricant having a melting point that is lower than a compacting temperature, wherein the die lubricant for warm compaction with die lubrication is capable of being applied to the surface of a preheated die by electrical charging when a powder is compacted in the die.

2. A die lubricant for warm compaction with die lubrication, comprising:

a first lubricant having a melting point that is higher than a preset compacting temperature and in an amount from 0.5 to 80% by mass; and a second lubricant having a melting point that is lower than a compacting temperature; and wherein the die lubricant for warm compaction with die lubrication is capable of being applied to the surface of a preheated die by electrical charging when a powder is compacted in the die.

3. The die lubricant for warm compaction with die lubrication according to claim 2, wherein the high-melting lubricant is a member selected from the group consisting of metallic soap, thermoplastic resin, thermoplastic elastomer, and an organic or inorganic lubricant having a layer crystal structure.

4. The die lubricant for warm compaction with die lubrication according to claim 2, wherein the lower melting lubricant is a member selected from the group consisting of metallic soap, amide wax, polyethylene, and an eutectic mixture of at least two members thereof.

5. An iron-based powder mixture for warm compaction with die lubrication, comprising:

an iron-based powder;

a lubricant, the lubricant comprising:

a first lubricant having a melting point that is lower than a preset compacting temperature and in an amount from 10 to 75% by mass based on the total amount of the lubricant;

a second lubricant having a melting point that is higher than the compacting temperature; and graphite powder in an amount of less than 0.5% by mass based on the total amount of the iron-based powder mixture.

6. The iron-based powder mixture for warm compaction with die lubrication of claim 5, wherein the amount of the lubricant is in a range from 0.05 to 0.40% by mass.

7. A process for the production of a high-density iron-based green compact, comprising:

preheating a die to a selected temperature;

applying a die lubricant for warm compaction with die lubrication to a surface of the die by electrical charging;

filling a heated iron-based powder mixture in the die; and compacting the powder mixture at a preset compacting temperature;

wherein the die lubricant for warm compaction with die lubrication comprises:

a first lubricant having a melting point that is higher than the compacting temperature and in an amount from 0.5 to 80% by mass; and a second lubricant having a melting point that is lower than the compacting temperature; and wherein the iron-based powder mixture comprises an iron-based powder; and a lubricant, comprising:

a first lubricant having a melting point that is lower than the compacting temperature and in an amount from 10 to 75% by mass based on the total amount of the lubricant; and a second lubricant having a melting point that is higher than the compacting temperature.

8. A process for the production of a high-density iron-based green compact, comprising:

preheating a die at a selected temperature;

applying a die lubricant for warm compaction with die lubrication to a surface of the die by electrical charging;

filling a heated iron-based powder mixture into the die; and then compacting the powder mixture at a preset compacting temperature;

wherein the die lubricant for warm compaction with die lubrication comprises a first lubricant having a melting point that is higher than the compacting temperature and in an amount from 0.5 to 80% by mass; and a second lubricant having a melting point that is lower than the compacting temperature; and wherein the iron-based powder mixture comprises:

(i) an iron-based powder;

(ii) a lubricant comprising:

a first lubricant having a melting point that is lower than a compacting temperature and in an amount from 10 to 75% by mass based on the total amount of the lubricant; and a second lubricant having a melting point that is higher than the compacting temperature; and (iii) a graphite powder present in an amount less than 0.5% by mass based on the total amount of the iron-based powder mixture.

9. The process according to claim 7, wherein the higher-melting die lubricant is a member selected from the group consisting of metallic soap, thermoplastic resin, thermoplastic elastomer, and an organic or inorganic lubricant having a layer crystal structure.

10. The process according to claim 8, wherein the higher-melting die lubricant is a member selected from the group consisting of metallic soap, thermoplastic resin, thermoplastic elastomer, and an organic or inorganic lubricant having a layer crystal structure.

11. The process according to claim 7, wherein the lower-melting die lubricant is a member selected from the group consisting of metallic soap, amide wax, polyethylene, and an eutectic mixture of at least two members thereof.

12. The process according to claim 8, wherein the lower-melting die lubricant is a member selected from the group consisting of metallic soap, amide wax, polyethylene, and an eutectic mixture of at least two members thereof.

13. The process according to claim 7, wherein the lubricant in the powder mixture is added in an amount from 0.05 to 0.40% by mass.

14. The process according to claim 8, wherein the lubricant in the powder mixture is added in an amount from 0.05 to 0.40% by mass.

15. The process according to claim 8, wherein the lubricant in the powder mixture is added in an amount from 0.05 to 0.40% by mass.

16. The process according to claim 10, wherein the lubricant in the powder mixture is added in an amount from 0.05 to 0.40% by mass.

17. A process for the production of a high-density iron-based sintered compact, comprising the step of sintering the high-density iron-based green compact produced by a process according to claim 7, thereby forming a sintered compact.

18. A process for the production of a high-density iron-based sintered compact, comprising the step of sintering the high-density iron-based green compact produced by a process according to claim 8, thereby forming a sintered compact.

19. A process for the production of a high-density iron-based sintered compact, comprising the step of sintering the high-density iron-based green compact produced by a process according to claim 9, thereby forming a sintered compact.

20. A process for the production of a high-density iron-based sintered compact, comprising the step of sintering the high-density iron-based green compact produced by a process according to claim 10, thereby forming a sintered compact.

21. A process for the production of a high-density iron-based sintered compact, comprising the step of sintering the high-density iron-based green compact produced by a process according to claim 11, thereby forming a sintered compact.

22. A product produced by the process of claim 7, the product having:

an ejection force after compacting that is 20 MPa or less and a density that is 7.4 $Mg/m^3$ or greater.

23. A product produced by the process of claim 8, the product having:

an ejection force after compacting that is 20 MPa or less and a density that is 7.4 $Mg/m^3$ or greater.

* * * * *

UNITED STATES PATENT AND TRADEMARK OFFICE

CERTIFICATE OF CORRECTION

PATENT NO. : 6,355,208 B1
DATED : March 12, 2002
INVENTOR(S) : Shigeru Unami et al.

It is certified that error appears in the above-identified patent and that said Letters Patent is hereby corrected as shown below:

Column 26,
Line 26, change "claim 8" to -- claim 9 --

Signed and Sealed this

Fifth Day of November, 2002

*Attest:*

*Attesting Officer*

JAMES E. ROGAN
*Director of the United States Patent and Trademark Office*